US006702411B2

(12) United States Patent
Helver

(10) Patent No.: US 6,702,411 B2
(45) Date of Patent: Mar. 9, 2004

(54) HANDS FREE CABINET DRAWER ASSIST SYSTEM

(76) Inventor: Oscar Helver, 13340 SW. 128th St., Miami, FL (US) 33183

( * ) Notice: Subject to any disclaimer, the term of this patent is extended or adjusted under 35 U.S.C. 154(b) by 62 days.

(21) Appl. No.: 10/178,332

(22) Filed: Jun. 21, 2002

(65) Prior Publication Data

US 2003/0234600 A1 Dec. 25, 2003

(51) Int. Cl.[7] ..... A47B 88/00
(52) U.S. Cl. ..... 312/333; 312/311; 312/319.1
(58) Field of Search ..... 312/270.3, 273, 312/274, 275, 276, 311, 319.1, 290, 333; 292/146, 147, 332, 80

(56) References Cited

U.S. PATENT DOCUMENTS 2,233,796 A 3/1941 Pines
2,247,232 A * 6/1941 Goldberg ..... 312/274
2,530,336 A * 11/1950 Marini ..... 312/274
2,934,390 A 4/1960 Wright
3,714,890 A 2/1973 Moon
3,854,785 A * 12/1974 Manner et al. ..... 312/319.1
4,116,512 A 9/1978 Wiser
4,371,222 A 2/1983 Gorkiewicz
5,005,729 A 4/1991 Hollman
5,040,833 A * 8/1991 Brunnert ..... 292/80
5,215,363 A 6/1993 Warwick, III
5,474,374 A * 12/1995 Sandvig ..... 312/274
5,634,702 A 6/1997 Fistonich

* cited by examiner

*Primary Examiner*—John Fitzgerald
(74) *Attorney, Agent, or Firm*—Kevin P. Crosby, Esq.; Brinkley, McNerney, & et al.

(57) ABSTRACT

A waste receptacle or other household items are placed upon a movable shelf or drawer under the counter in a space covered by an openable door. The shelf or drawer is movable between a first, retracted, mounted position stowed within the cabinet and a second, deployed, position removed from the cabinet. The user can withdraw the shelf or drawer hands-free from the cabinet and place items within the waste receptacle or drawer by simply opening the cabinet door. To stow the tray or drawer, the user simply pushes the tray or drawer back within the cabinet, into the retracted position. A novel latch assembly retains the drawer or tray, and, hence the receptacle or other item(s), in the retracted position, and the door can be closed to conceal the same. Upon closing the door, a lever attached to the door causes the latch mechanism to unlatch, releasing the drawer, which then abuts against the cabinet door. Means may be provided for retaining the cabinet door in its closed position until the user desires to access the waste receptacle or drawer. Then, the user simply opens the door, causing the tray or drawer to be automatically deployed by a biasing mechanism.

11 Claims, 3 Drawing Sheets

HANDS FREE CABINET DRAWER ASSIST SYSTEM

BACKGROUND OF THE INVENTION

1. Field of the Invention

This invention relates to the field of kitchen cabinet convenience devices, and, more particularly, relates to a system wherein a waste container or cabinet drawer is positioned within a kitchen cabinet and automatically moves outside of the cabinet upon opening of the cabinet door covering same.

2. Description of the Background Art

It is commonplace to place a kitchen garbage receptacle on the floor. These containers usually have a relatively short period of usage during the workday and are otherwise often cumbersome and unsightly inconveniences to be left out in the open. Some containers such as tool bins, storage bags, waster paper baskets, hampers and similar items suffer from the same draw backs. Although it is necessary to have such a container available for occasional use, it is nevertheless usually an obstruction when not being used.

In the past, it has been proposed to use the space between the supporting legs of a desk, for example, and similar recesses such as the space under a kitchen sink, to position such containers in a spot that is both convenient and not cumbersome. However, if the basket or similar container is positioned in a recess of a desk or cabinet, then it must frequently be moved to deposit items therein. Also, it has become popular to use oversized drawers to stow such items as pots, pans and small appliances. Gaining access to such drawers when ones hands are either occupied or wet, etc, becomes unnecessarily burdensome.

One solution to this problem is addressed in U.S. Pat. No. 4,111,506, wherein a system is shown for carrying a waste basket or similar item into and out of the recess of, for example, a desk or cabinet. The invention of the '506 patent moves the waste basket or drawer or similar item by means of a roller along a tiltable hanging bar. The degree of force necessary to move the basket along the hanger rod is somewhat greater than desired, installation of the device is difficult, and the space or housing within the desk or cabinet is restricted.

Another attempt at solving the problem is disclosed in U.S. Pat. No 4,371,222, which discloses a retractable scissors tong mechanism supported within a cabinet or the like, which employs a mechanism used to support or carry a waste basket between stowed and accessible positions.

Waste containers including garbage cans are conventionally placed in a convenient comer or the like in the kitchen or other area in which the container is to be used. Frequently, removable liners are provided for such containers and these generally are in the form of conventional paper bags, plastic bags, or the like in which the mouth of the bag is merely laid over the top of the container.

Cans receiving kitchen wastes are usually provided with a can which can be opened by a step-on mechanism. Other developments in this art include garbage containers which are mounted in concealed relation within a cabinet or the like and, when the container is moved to an exposed position, the container lid is automatically opened. An example of this type of construction is found in U.S. Pat. No. 2,934,390. An example of a garbage can with a liner is found in U.S. Pat. No. 1,886,406. However, such devices have not been accepted in the field of use as the structures have failed to dependably produce the desired results.

U.S. Pat. No. 3,528,718 to Johnson teaches a container such as a garbage can of a relatively large capacity having a liner disposed therein with a detachable connection between the upper end of the liner and the upper end of the container to stabilize the liner within the container but yet enable ready removal thereof with the connecting structure and the liner serving as a rigidifying handle to enable lifting of the liner when it has been filled with waste material.

The garbage container forms a component 10 and includes a substantially flat bottom 12 of a rectangular configuration and upstanding end walls 14 and sidewalls 16 which terminate at the upper edge thereof in an outwardly extending flange 18 which in turn terminates in a downwardly extending flange 20.

The downwardly extending flange 20 is substantially continuous but discontinuously at 22 along the end walls thereof to provide handholds for facilitating removal of the container 10. Attached to the upper surface of the peripheral flange 18 is a rib 24 of cylindrical configuration which is secured thereto by any suitable means such as by an adhesive or being molded as an integral part thereof or attached thereto by a heat sealing operation or the like as at 26.

The central portion of the rib along each sidewall 16 is discontinuous at 8. Also, each side portion of the flange 18 is provided with a pair of depending projections 30 each of which is in the form of a shank having a rounded enlargement 32 on the lower end thereof which has a particular function.

U.S. Pat. No. 4,120,548 Manor relates to bins which serve domestic purposes and which may be kept in a cupboard or similar compartment.

It is known to suspend the bin from and alongside of a parallelogram four-bar-linkage. The rear one of the bars extends vertically and in parallel with the inner side of the door of the respective cupboard, and is adapted to be affixed to a doorpost or like stationary member. The opposite front bar of the four-bar-linkage is provided with means for removably affixing thereto the bin. Some kind of stop means has to be provided in order to arrest the system in the elevated position to prevent it from collapsing back under the weight of the loaded bin.

The provision of such stop means has caused inconvenience in the use of the device and increased the manufacturing costs thereof.

In the usual cases where the bin assembly is installed in a kitchen cupboard, the conventional arrangement did not provide for the interchangeability between right and left-hand mounting requisites. Hence, two different types of holder units had to be produced and sold separately to the public, and/or always readily available in inventory.

U.S. Pat. No. 4,120,548 to Manor teaches a displaceable garbage bin holder having a support frame swingable about a vertical axis provided at a rear side of the frame and a linkage system for the vertical displacement of the bin. The linkage system includes first, second, and third link-bars. The first link-bar is pivotably mounted at one end to the front end of the frame by a first journal. The second link-bar is pivotably mounted at one end to the front end of the frame by a second journal located below the first journal. The first link-bar is pivotably mounted to the opposite ends of the first and second link-bars by third and fourth journals, respectively. Means are provided for suspending a garbage-bin on the third link-bar and a handle for pivoting the linkage system about the first and second journals so that the third journal is displaced from a lower position to an elevated position beyond the upper dead-center of the linkage system defined by a line passing through the first and second journals for stably supporting the linkage system in an elevated position.

For interchangeability, the frame includes an upper frame-bar and a lower frame bar. The first and second link-bars are installed at one side of both the upper and lower frame-bars. The third link-bar extends across the opposite sides of the upper and lower frame-bars, respectively.

U.S. Pat. No. 5,005,729 to Hollman discloses a displaceable waste basket and shelf tray concealed within a cabinet when not is use. The device employs a recessed slide mechanism for displacing the tray from an extended position to a retracted position and vice versa. However, the device of the '729 patent does not permit the retraction of the tray and waste basket without closing the cabinet door because of the positive connection between the cabinet door and the tray made by the slide mechanism.

U.S. Pat. No. 5,215,363 to Warwick discloses a waster basket concealment system in which the waste basket has a cover hingedly secured thereto and the waste basket is moveable between a retracted and a deployed position. The device utilizes a fairly complicated, and breakage prone, gear system and cable/pulley system to operate. The lid is simultaneously opened when the water basket is moved exteriorly of the cabinet.

U.S. Pat. No. 5,634,702 to Fistonich discloses a kitchen trash container system where a trash container is covered when it is within a kitchen cabinet enclosure and wherein the cover automatically opens when the trash container is caused to move outwardly from the cabinet. A complex and breakage prone system of pulleys and weight is employed, and a spring is utilized to bias the trash container into a retracted position within the cabinet.

None of the previous attempts of which the inventor is aware provide an imminently simple and essentially maintenance free system for allowing hands-free deployment of the waste basket and slidable tray or drawer upon opening of the cabinet door covering the space within which the waste receptacle is kept during non-use.

Many kitchens are now provided with cabinets dedicated to house a waste receptacle/storage drawer. Some of these include a drawer slidable between a retracted position stowed within the cabinet and a deployed position in which the receptacle and drawer reside outside of the cabinet so that trash or other items can be placed into the receptacle.

SUMMARY OF THE INVENTION

It is, therefore, an object of this invention to provide a solution to the problem of self-deploying trash and storage receptacles that is simple, inexpensive and substantially maintenance free.

It is also an object of this invention to provide a trash or storage receptacle concealment system in which the receptacle is concealed from view when not in use, but which automatically deploys on a hands-free basis when the cabinet door covering same is opened.

It is, therefore, a principal object of this invention to provide moveable waste or storage receptacle under the counter in the kitchen or other room. A waste receptacle or other household items are placed upon a movable shelf or drawer under the counter in a space covered by an openable door. The shelf or drawer is movable between a first, retracted, mounted position stowed within the cabinet and a second, deployed, position removed from the cabinet. The user can withdraw the shelf or drawer hands-free from the cabinet and place items within the waste receptacle or drawer by simply opening the cabinet door. To stow the tray or drawer, the user simply pushes the tray or drawer back within the cabinet, into the retracted position. A novel latch assembly retains the drawer or tray, and, hence the receptacle or other item(s), in the retracted position, and the door can be closed to conceal same. Upon closing the door, a lever attached to the door causes the latch mechanism to unlatch, releasing the drawer, which then abuts against the cabinet door. Means may be provided for retaining the cabinet door in its closed position until the user desires to access the waste receptacle or drawer. Then, the user simply opens the door, causing the tray or drawer to be automatically deployed by a biasing mechanism.

These and other objects and features of the invention will be more readily understood from a consideration of the following detailed description, taken with the accompanying drawings, in which corresponding parts are indicated by corresponding numerals.

BRIEF DESCRIPTION OF THE DRAWINGS

With respect to the above described description, it is to be realized that the optimum dimensional relationships for the parts of the invention, to include variation in size, materials, shape, form, function and manner of operation, assembly and use are deemed relatively apparent and obvious to one skilled in the art, and all the equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents are considered to fall within the scope of the invention.

DESCRIPTION OF THE INVENTION

Figure 1:
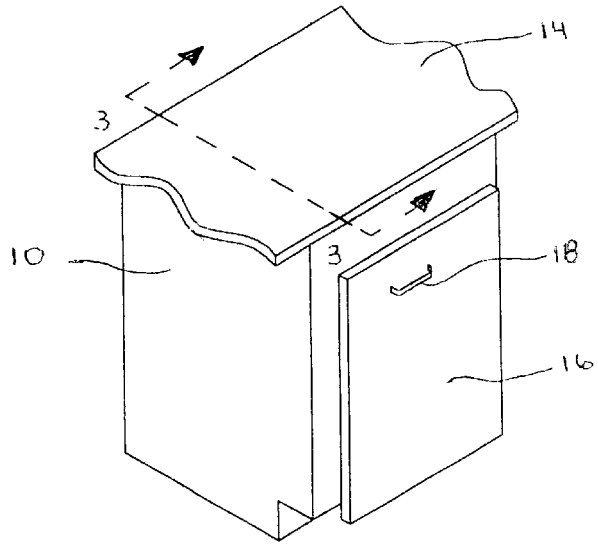
FIG. 1 is a perspective view of a cabinet of the type which may be utilized with this invention with the cabinet door in the closed position.

Referring now to the drawings, the invention is directed to a system for permitting hands-free access to a drawer or waste container upon the opening of a cabinet door.

Figure 2:
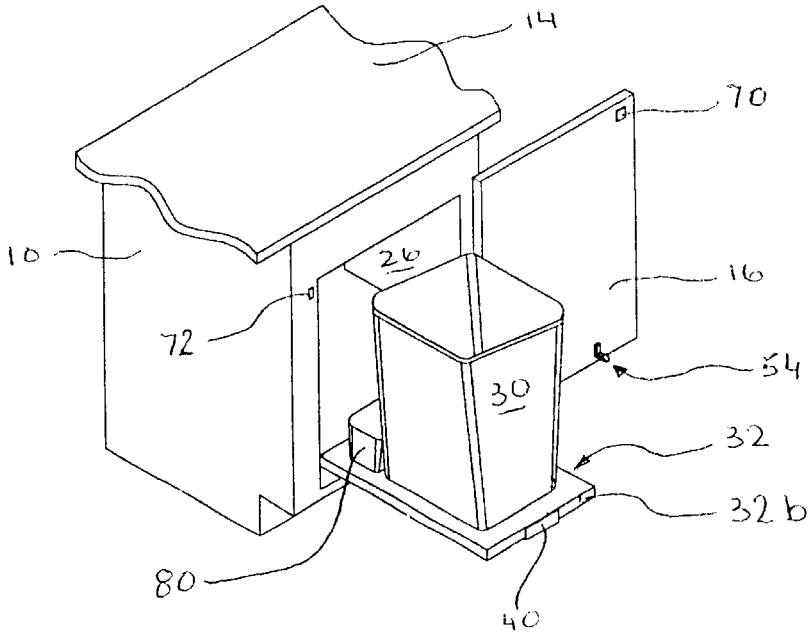
FIG. 2 is a perspective view of the system of the invention shown in the deployed state.

The invention can be employed in a kitchen cabinet or any other space where a cabinet member such as a trash receptacle or storage drawer can be concealed from vision during periods of non-use. In the embodiment shown in the drawings, which is not intended to limit the scope of the invention, a typical cabinet 10 is shown disposed beneath a countertop 14. A space 26 in which the drawer or trash receptacle 30 is to be concealed is hidden behind a cabinet door 16. Cabinet door 16 pivots about hinges (not shown) upon being opened or closed. A handle 18 facilitates the opening or closing of door 16. Obviously, any suitable structure for permitting a user to grasp or otherwise manipulate door 16 between the closed position shown in FIGS. 1 and 3 and the open position shown in FIGS. 2, 4 and 5 is contemplated.

As has been explained, the invention can be employed with either a storage drawer of a cabinet or a waste receptacle. In the embodiment in which a waste receptacle is stowed, waste basket 30 sits upon a reciprocally movable shelf or tray 32. Waste basket 30 may be connected to tray 32 in a manner, such as by sitting within a correspondingly shaped relief or cutout, by hook and loop fastener, by magnets, by a bracket, or by any means, or may simply sit atop tray 32 without anything holding it in place. In the embodiment in which a storage drawer is used, tray 32 is replaced by a drawer (not shown). The reminder of the description will speak in terms of tray 32 and waste basket 30, but it is to be understood that a drawer may be substituted for these elements and still fall within the scope of the invention.

Figure 3:
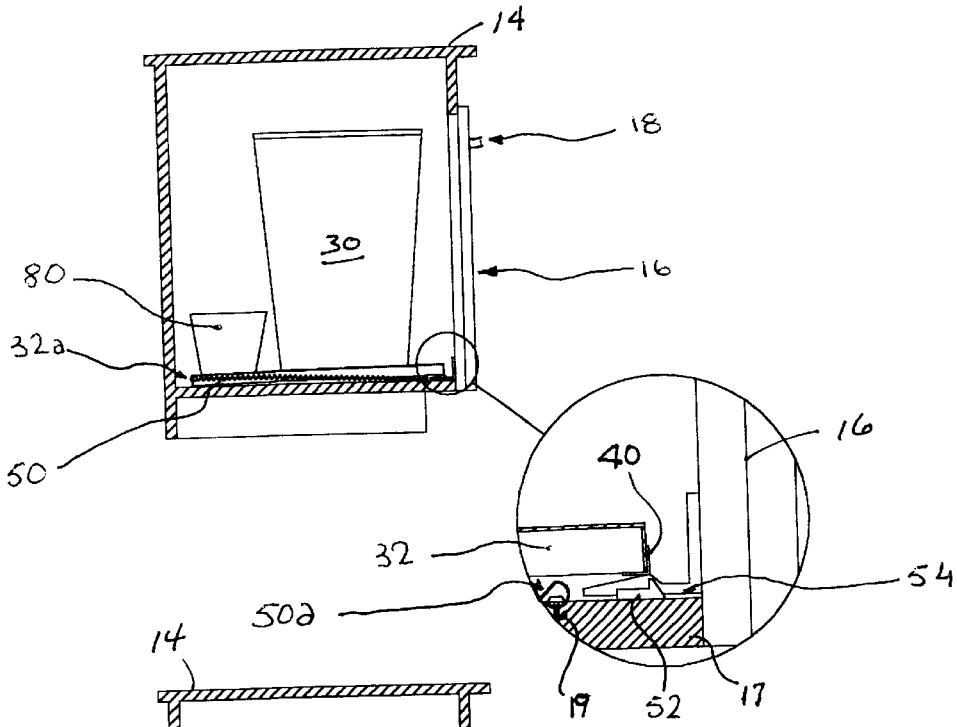
FIG. 3 is a side elevational cutaway view taken along lines 3—3 of FIG. 1.
Figure 4:
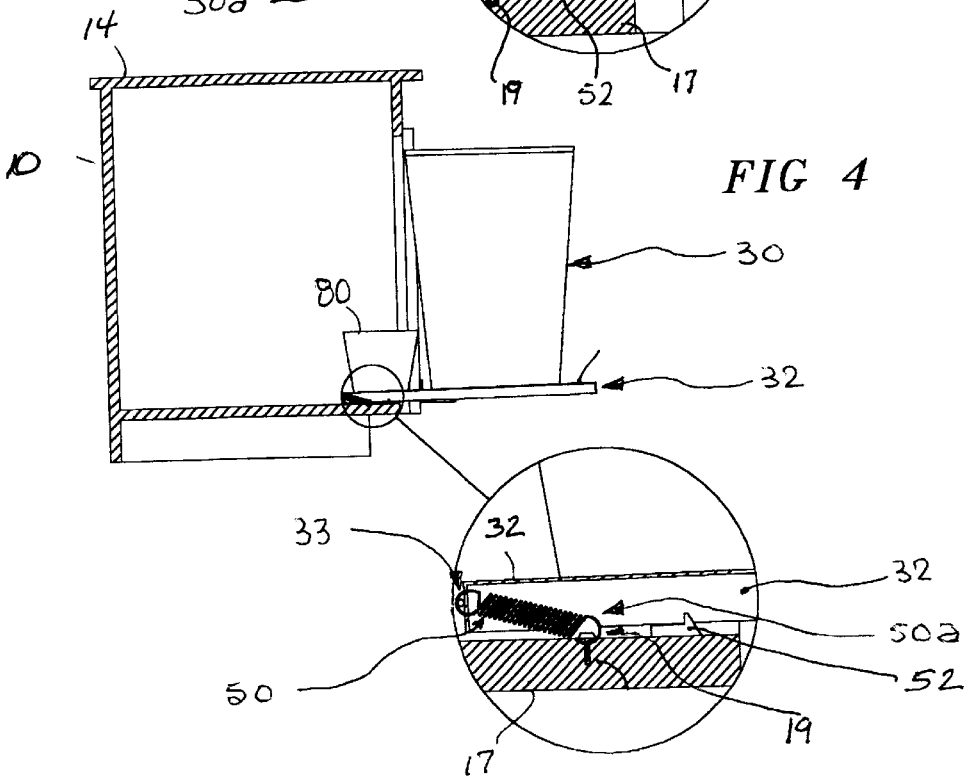
FIG. 4 is a side elevational cutaway view of the system shown in FIG. 3 in the deployed state.
Figure 5:
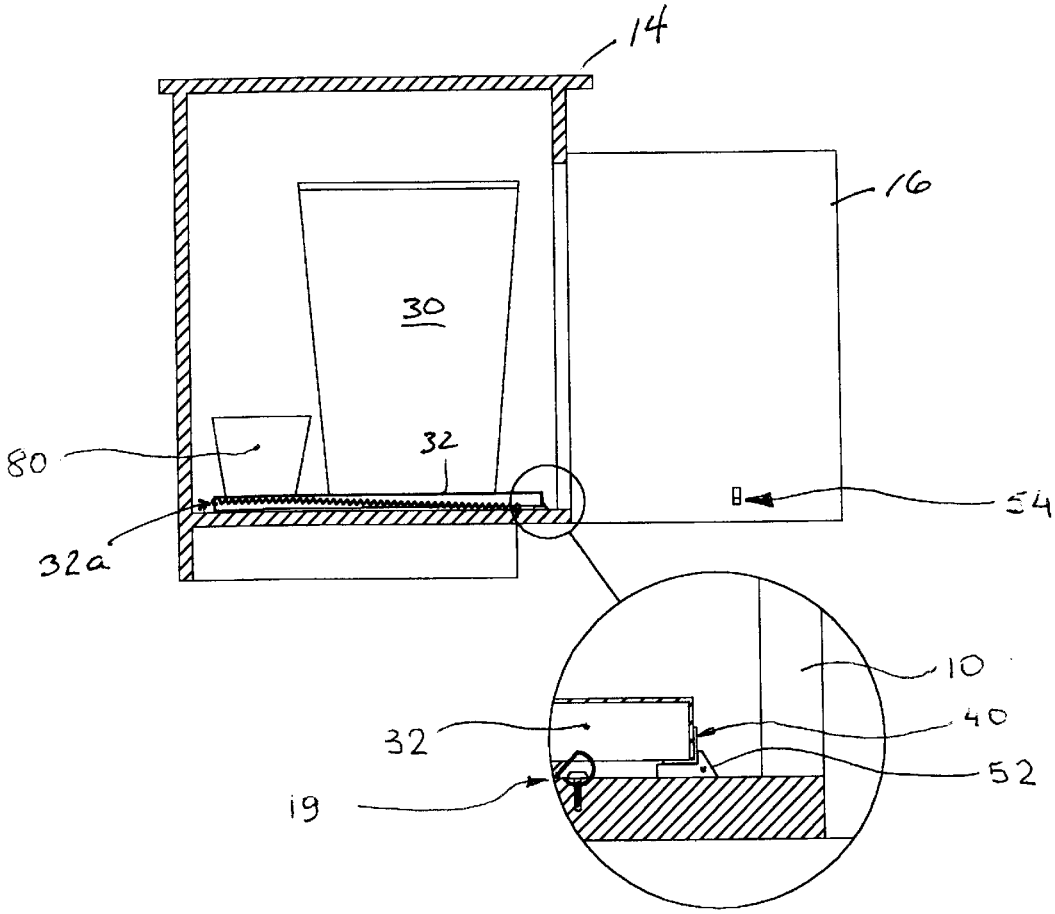
FIG. 5 is a side elevational cutaway view of the system of the invention with the waste receptacle and slidable tray in the retracted position with the cabinet door open.

Tray 32 is moveable between a retracted position such as that shown in FIG. 3 and a deployed position such as that shown in FIG. 4. In order to create a hands-free operation, which is desirable when a user has something in his or her hands to discard in to the waste basket 30 or drawer (not shown), a tension spring 50 is positioned so as to pull tray (or drawer) 32 out of space 26 when door 16 is opened. Spring 50 connects to the rearward end 32*a* of tray 32 via a catch device 33, which may be a simple screw inserted into tray 32, or any element which will permit connection of spring 50 to the rearward end 32*a* of tray 32. The forward end 50*a* of spring 50 is connected to cabinet base 17 via a suitable structure such as loop 19. In this way, with spring 50 being pre-tensioned when in the position shown in FIG. 3, upon opening of cabinet door 16, spring 50 will urge tray 32 or drawer (not shown) to slide outwardly to the position shown in FIG. 4. Once the trash is deposited into receptacle 30, and it is desired to retract receptacle 30 into the stowed position shown in FIG. 3, the user simply pushes tray 32 or receptacle 30 rearwardly until the leading edge 32*b* of tray 32 comes into contact with catch 52 as shown in FIG. 5. A protective shield 40 may be attached to leading edge 32*b* at tray 32 to prevent leading edge 32*b* from getting frayed or otherwise worn by the reciprocal movement of catch 52. Therefore, it can be seen that once tray 32 is moved into the retracted position shown in FIG. 5, while door 16 is still open, tray 32 and receptacle 30 will be retained in the retracted position by way of engagement of leading edge 32*b* against catch 52.

Upon closing door 16, lever 54 connected near a bottom edge of door 16 will engage the underside of leading edge 32*b* of tray 32, as shown in FIG. 3, to raise leading edge 32*b* out of engagement with catch 52, such that when door 16 is re-opened, engagement member 54 will draw tray 32 outwardly slightly to move leading edge 32*b* (outwardly to the right in FIG. 3) of catch 52, whereupon spring 50 will draw tray 32 or drawer (not shown) into the fully deployed position shown in FIG. 4.

A retaining means such as a latch or magnet 70, 72 may be utilized to retain door 16 in the closed position. Such a device is not necessary, however, to operation of the device. Another manner of holding door 16 closed would be by the use of spring-biased hinges (not shown). However, as previously mentioned, it is not necessary to have any means retaining door 16 in the closed position for the invention to function in accordance with the principles set forth herein.

Latching mechanism 70–72 such as a magnet or other well-known means for latching a cabinet door closed may also be employed, as shown in FIG. 2.

Also, an auxiliary receptacle 80 may be employed in association with tray 32 to store a supply of miscellaneous items such as trash bags. In this way, a handy and efficient hands-free trash system is provide, unlike any previously proposed of which the inventor is aware.

This description, together with the objects of the invention and the various features of novelty which characterize the invention are pointed out with particularity in the claims annexed hereto and forming a part of this disclosure. For a better understanding of the invention, its operating advantage and the specific objects attained by its uses, reference should be had to the accompanying drawings and descriptive matter in which there is illustrated at least one preferred embodiment of the invention.

What is claimed is:

1. A system for deploying a cabinet member into, and retracting the cabinet member out from, a cabinet, the cabinet characterized in having a base housing covered by at least a portion of a countertop, the base housing and countertop defining a storage space therewithin, and a door attached to the housing pivotable between an open position through which access to the storage space can be gained, and a closed position, comprising:

a cabinet member slidably associated with the cabinet and movable between a retracted position within the space and a deployed position at least partially outside of the space when the door is in its open position;

means for biasing the cabinet member toward the deployed position;

means for releasably retaining the cabinet member in the retracted position, said means for retaining connected to the base cabinet;

means for releasing the cabinet member from the means for retaining upon closure of the door;

wherein the cabinet member is automatically deployed from the space when the door is opened.

2. The system of claim 1, wherein the means for biasing is a tension spring.

3. The system of claim 1, wherein the means for retaining includes an L-shaped catch.

4. The system of claim 1, wherein the means for releasing is a generally horizontally disposed post attached to the door adapted to engage a leading edge of the cabinet member.

5. A hands-free system for concealingly housing a cabinet member utilized in a cabinet having a cabinet housing and a countertop element defining an interior space within which the cabinet member can be stored, a hinged door adapted to conceal the space when closed and permit access to the space when open, and a cabinet member slidingly associated with the cabinet, comprising;

a catch connected to the cabinet housing for retaining the cabinet member in a retracted position within the cabinet;

means for releasing the cabinet member from engagement with the catch, said means for releasing attached to the door;

a tension spring connected between the cabinet housing and the cabinet member for urging the cabinet member to move toward the deployed position;

said means for releasing the cabinet member causing the cabinet member to become disengaged from the catch when the door is closed.

6. The system of claim 5, wherein the spring is connected at one end to a rear section of the cabinet member and at its other end to a forward portion of the cabinet.

7. The system of claim 5 further comprising a protective shield associated with a forward edge of the cabinet member adapted to be engaged by the catch when the cabinet member is in the retracted position.

8. A concealment system for a cabinet member adapted to be associated with a base cabinet, the cabinet being characterized as having left and right upstanding side walls, a floor, a horizontal top, as well as a front opening openably covered by a door, and a slidable cabinet member associated with the cabinet adapted to slide between a retracted position within the cabinet and a deployed position at least partially removed from the cabinet, comprising;

means for pulling the cabinet member from the retracted position toward the deployed position;

means for releasably retaining the cabinet member in the retracted position;

means for releasing the cabinet member from connection with the means for retaining, said means for releasing attached to the door and being removed from connection to the cabinet member when the door is opened.

9. The device of claim 8, wherein the means for releasing is a post attached to the door of the cabinet.

10. The device of claim 8, wherein the means for releasing is a post attached to the door which contacts an underside forward edge of the cabinet member when the door is closed, disengaging the cabinet member from contact with the means for retaining.

11. The device of claim 9, wherein the means for releasing is a post attached to the door which contacts an underside forward edge of the cabinet member when the door is closed, moving the cabinet member from out of contact with the means for retaining.

* * * * *